United States Patent [19]

Brey

[11] 4,408,762

[45] Oct. 11, 1983

[54] ELECTRONIC PINBALL GAME

[75] Inventor: Arthur L. Brey, Antioch, Ill.

[73] Assignee: Bally Manufacturing Corporation, Chicago, Ill.

[21] Appl. No.: 273,246

[22] Filed: Jun. 12, 1981

Related U.S. Application Data

[63] Continuation of Ser. No. 92,993, Nov. 9, 1979, abandoned.

[51] Int. Cl.[3] ..... A63F 7/02

[52] U.S. Cl. ..... 273/121 A; 40/219; 40/900

[58] Field of Search ..... 273/118 A, 119 A, 120 A, 273/121 A, 122 A; 40/219, 900; 340/323 R

[56] References Cited

U.S. PATENT DOCUMENTS

| | | | |
|---|---|---|---|
| 2,114,711 | 4/1938 | Horinstein | 40/900 |
| 2,529,535 | 11/1950 | Bertelsmeyer | 340/323 R |
| 2,864,619 | 12/1958 | Burnside | 273/121 A |
| 4,093,232 | 6/1978 | Nutting et al. | 273/121 A |
| 4,139,955 | 2/1979 | Reiback | 40/219 |
| 4,164,823 | 8/1979 | Marsico | 40/219 |

*Primary Examiner*—Vance Y. Hum
*Attorney, Agent, or Firm*—Welsh & Katz

[57] ABSTRACT

A pinball machine controlled by a micro computer including a micro processing unit. A display in the pinball machine comprises an infinity box including a one-way mirror, a two-way mirror disposed in spaced, parallel relation to the one-way mirror, and a plurality of lamps disposed in the space between the two mirrors. A plurality of switches are provided for energizing respective lamps, the micro processing unit being connected to the plurality of switches so as to actuate the plurality of switches in a predetermined sequence whereby the lamps are energized in the predetermined sequence.

8 Claims, 1 Drawing Figure

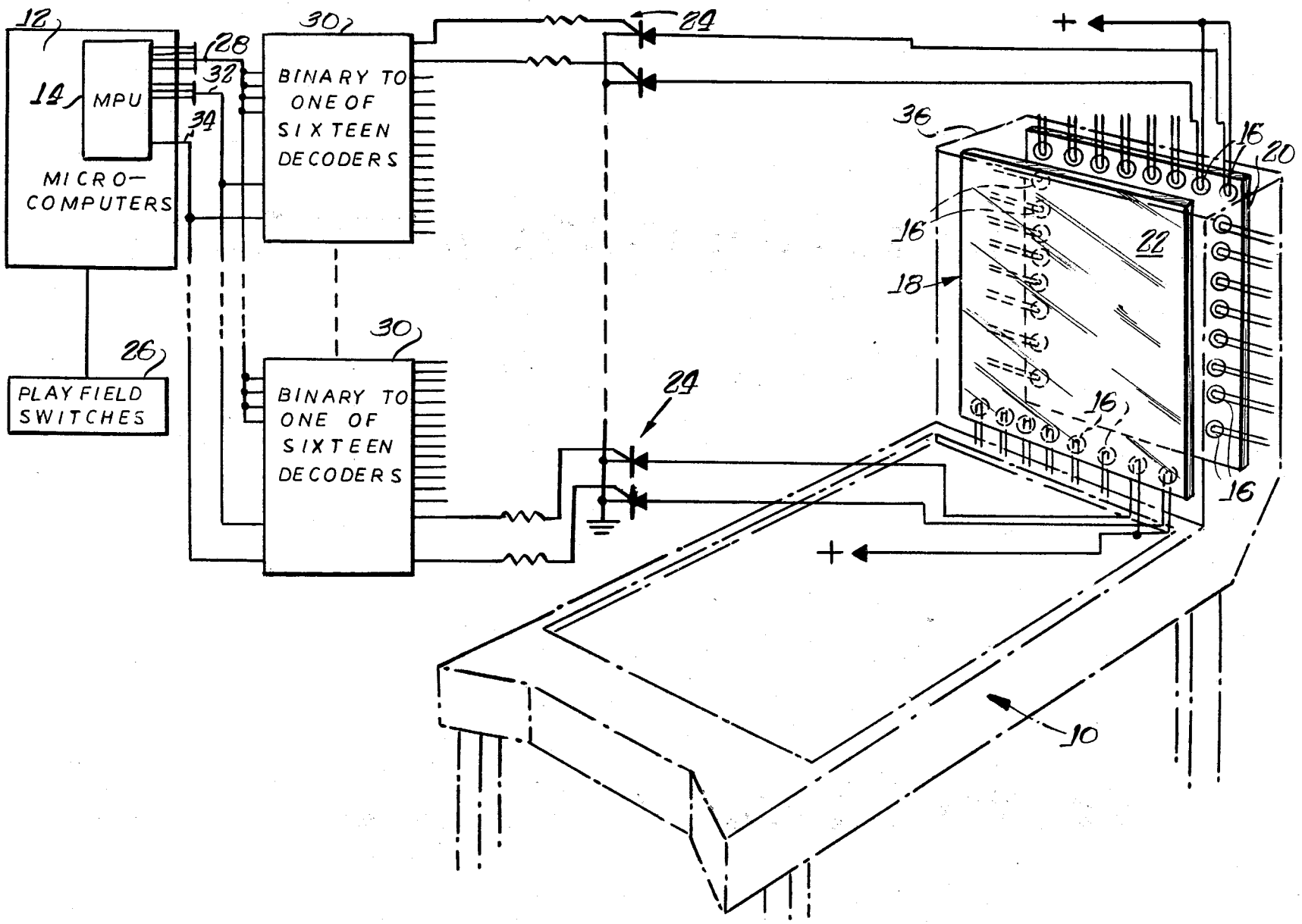
BINARY TO ONE OF SIXTEEN DECODERS
BINARY TO ONE OF SIXTEEN DECODERS
MPU
MICRO-COMPUTERS
PLAY FIELD SWITCHES
+
+

ELECTRONIC PINBALL GAME

This is a continuation, of application Ser. No. 06/092,993, filed Nov. 9, 1979, now abandoned.

The present invention relates to an electronic pinball machine and, more particularly, to a display in the electronic pinball machine.

In recent years pinball machines have utilized micro computers to drive the solenoids on the playing field as well as the indicator lamps to indicate the score. In certain computerized or electronic pinball machines, the micro processor has also been used to drive sound making devices whereby different sounds are produced in response to different game related functions. This sound effect has enhanced the enjoyment of the player.

It is an object of the present invention to provide, in an electronic pinball machine, a display means wherein visual effects are employed to enhance the amusement of the player. Another object is the provision in an electronic pinball machine of an infinity box display having lamps therein which are lit at a speed or in a predetermined sequence in response to a game related function.

Other objects and advantages of the present invention will become apparent by reference to the following description and accompanying drawing wherein the single FIGURE is a diagrammatic drawing of an electronic pinball machine with a display constructed in accordance with the present invention.

Generally, in accordance with the present invention, an electronic pinball machine 10 is conrolled by a micro computer 12 including a micro processing unit 14. The micro processing unit 14 is connected so as to control the energization of a plurality of lamps 16 in an infinity box 18. The infinity box 18 includes a one-way mirror 20 disposed in the box 18, a two-way mirror 22 disposed in the box 18, in spaced, parallel relation to the one-way mirror 20, the plurality of lamps 16 being disposed in the space between the two mirrors. The output of the micro processing unit 14 is connected to a plurality of switch means 24, which energize respective lamps 16 so as to actuate the plurality of switch means 24 in a predetermined sequence whereby the lamps 16 are energized in the predetermined sequence.

More specifically, the electronic pinball machine 10, in accordance with the present invention, includes the micro computer 12 which may be of the type disclosed in a copending patent application, Ser. No. 633,470, filed Nov. 19, 1975, which is assigned to the assignee of the present application. Another micro computer which also may be used is employed in an electronic pinball game manufactured and sold by Bally Manufacturing Corporation under the designation model No. 1152-E KISS. The micro computer 12 is controlled by switches 26 on the playfield of the pinball machine 10 and by other switches (not shown) on the machine. The micro computer 12 generally includes the micro processing unit 14, which may be a Motorola 6820/6821, a clock (not shown), a plurality of read only memories (not shown), random access memories (not shown), and peripheral interface adaptors (not shown).

Four output leads 28 from the micro processing unit 14 are employed as a lamp address and are connected in parallel to a plurality of binary to one of sixteen decoders 30. The decoders 30 may be a type MC14514CP. The number of decoders 30 used depends on the number of outputs needed for the number of lamps 16 and, in the illustrated embodiment, three counters are employed to energize thirty-two lamps. The specific one of the three binary decoders 30 is selected by three output leads 32 from the micro processing unit 14, which serve as lamp data, and are respectively connected to the binary decoders 30. The binary decoders 30 are turned on by a strobe pulse applied to each decoder through a lamp strobe lead 34 from the micro processing unit 14.

As shown in the drawing, the outputs of the decoders 30 are connected respectively to the gates of a plurality of switching means 24 which, in the illustrated embodiment, are SCR's. An SCR may be provided for each of the lamps 16, or for each diagonally opposite pair of lamps 16. The cathodes of the SCR's 24 are connected in parallel to ground and the anodes of the SCR's 24 are connected to the respective lamps 16 in the infinity box 18.

The infinity box 18 is mounted so as to form the front of the back box of a pinball machine. It includes the one-way mirror 20 which is rectangular in shape and is mounted to the rear of a rectangular frame 36. The one-way mirror 20 may be etched to permit viewing of suitable artwork (not shown) mounted on the rear surface of the one-way mirror or to permit viewing of scoring registers (not shown).

The plurality of lamps 16 are mounted in spaced relation along each side of the frame 36, the bulb of the lamp extending inwardly of the frame. In the illustrated embodiment, eight lamps 16 are provided along each side of the frame 36. A lamp may be eliminated if it would be positioned opposite an etched portion of the one-way mirror 20. The two-way mirror 22, which is rectangular in shape, is mounted on the front of the frame 36 in spaced relation to the one-way mirror 20. The transmission factor of the two-way mirror 22 is determined by the amount of light which one desires to pass through the two-way mirror 22. For higher ambient light, the transmission factor should be higher. A forty-five percent transmission factor may be used.

The spacing between the one-way mirror 20 and the two-way mirror 22 is determined by the desired illusion of depth of the lighted lamps subject to view by the player. The larger the spacing, the greater the illusion of depth. In the illustrated embodiment, a spacing of one and one-half inches is employed. The number of repetitions of the lighted lamps subject to view of the player is determined by the brilliance of the light source and the combined reflectivity of the two mirrors.

The program of the micro computer 12 is written in a conventional manner so that different sequences of the lighting of the lamps 16 are obtained in accordance with the actuation of playfield switches 26. In one embodiment, one lamp on each side of the box 18 is energized at a time. The far left lamp on the upper side, the upper lamp on the right side, the far right lamp on the bottom side and the lower lamp on the left side are initially energized. The lamps on each side are then energized in sequence for equal time intervals and the sequence is repeated when the last lamp on the side is lit so as to produce a clockwise rotational effect of multireflected lights. The program may also be written to sequentially energize the lamps so as to produce a counter-clockwise rotational effect of multireflective lights. The speed of energization of the lamps, and thus the rotational effect, is increased upon the occurrence of a certain event sensed by the playfield switches, such as the striking of a certain bumper by the ball during play and is increased further upon the striking of another bumper. This movement of multireflected lights which increases in accordance with the skill of the player enhances the amusement of the player.

A different program may be written so that two lamps on each side of the box, adjacent the midpoint of the side, are lit. The lamps are then energized in sequence for predetermined time intervals in directions away from the midpoint and, when the last lamps on the side are lit, the sequence is repeated. The speed of the outward movement of the multireflected lights is increased as additional playfield switches or harder hit playfield switches are actuated. The different sequences may be provided in the same pinball game with a particular sequence being selected by a different type of play related function.

In another embodiment, a panel (not shown) of insulating material is disposed directly behind the artwork on the one-way mirror 20. A plurality of lamps (not shown) are mounted on this panel, some of which or all of which are controlled by the micro processor unit 14 in the above described manner. This provides a movement of the repetitive effect of the images contained in the artwork.

Various changes and modifications may be made in the above described electronic pinball game without deviating from the spirit or scope of the present invention. Various features of the present invention are set forth in the following claims.

What is claimed is:

1. In a pinball machine which is controlled by a micro computer including a micro processing unit and which includes a plurality of switches on its playfield which are actuated by the pinball and provide signals to the micro computer, a display means comprising an infinity box including a one-way mirror disposed in the box, a two-way mirror disposed in said box in spaced relation to said one-way mirror, and a plurality of lamps disposed so as to provide repetitive images to the viewer of the display means, said lamps being disposed in the space between the two mirrors, and a plurality of switch means for energizing respective lamps, said micro processing unit being connected to said plurality of switch means so as to repetitively actuate said plurality of switch means in a predetermined sequence in accordance with the actuation of the playfield switches, whereby the lamps are energized in the predetermined sequence to create apparent rotational motion of the repetitive images of the display means, the micro processing unit repetitively actuating said plurality of switch means at different sequential speeds as determined by different play related functions to create apparent rotational motion at different speeds, said play related functions being determined by the actuation of predetermined playfield switches.

2. A pinball machine in accordance with claim 1 wherein the lamps are spaced along the margin of the two-way mirror.

3. A pinball machine in accordance with claim 1, wherein the mirrors are rectangular and parallel mounted, a plurality of lamps are spaced along each margin of the two-way mirrors, and said lamps along each margin are energized in sequence.

4. A pinball machine in accordance with any of the claims 1, 2, or 3, wherein the micro processing unit actuates said plurality of switch means in different repetitive sequences as determined by different play related functions.

5. In a pinball machine which is controlled by a micro computer including a micro processing unit and which includes a plurality of switches on its playfield which are actuated by the pinball and provide signals to the micro computer, a display means comprising an infinity box including a one-way mirror disposed in the box, a two-way mirror disposed in said box in spaced relation to said one-way mirror, and a plurality of lamps disposed so as to provide repetitive images to the viewer of the display means, said lamps being disposed in the space between the two mirrors, and a plurality of switch means for energizing respective lamps, said micro processing unit being connected to said plurality of switch means so as to repetitively actuate said plurality of switch means in a predetermined sequence in accordance with the actuation of the playfield switches, whereby the lamps are energized in the predetermined sequence to create apparent rotational motion of the repetitive images of the display means, the microprocessing unit actuating said plurality of switch means in different repetitive sequences as deteermined by different play related functions, said play related functions being determined by the actuation of predetermined playfield switches.

6. A pinball machine in accordance with claim 5 wherein the lamps are spaced along the margin of the two-way mirror.

7. A pinball machine in accordance with claim 5, wherein the mirrors are rectangular and parallel mounted, a plurality of lamps are spaced along each margin of the two-way mirrors, and said lamps along each margin are energized in sequence.

8. A pinball machine in accordance with any of the claims 5, 6 or 7, wherein the micro processing unit repetitively actuates said plurality of switch means at different sequential speeds as determined by different play related functions to create apparent rotational motion at different speeds.

* * * * *

UNITED STATES PATENT AND TRADEMARK OFFICE

CERTIFICATE OF CORRECTION

PATENT NO. : 4,408,762

DATED : October 11, 1983

INVENTOR(S) : Arthur L. Brey

It is certified that error appears in the above-identified patent and that said Letters Patent is hereby corrected as shown below:

Column 2, line 19, after "machine" insert -- 10 --

Column 4, line 36, change "deteermined" to -- determined --.

Signed and Sealed this

*Thirteenth* Day of *November 1984*

[SEAL]

*Attest:*

GERALD J. MOSSINGHOFF

*Attesting Officer*

*Commissioner of Patents and Trademarks*